US006899288B2

(12) United States Patent
Filicicchia et al.

(10) Patent No.: US 6,899,288 B2
(45) Date of Patent: May 31, 2005

(54) MULTI-NOZZLE SPRAY BAR WITH SEGMENTED HEADER

(75) Inventors: Daniel J. Filicicchia, Londonderry, NH (US); Michel R. Thenin, Nashua, NH (US); Robert L Trottier, Nashua, NH (US)

(73) Assignee: Spraying Systems Co., Wheaton, IL (US)

( * ) Notice: Subject to any disclaimer, the term of this patent is extended or adjusted under 35 U.S.C. 154(b) by 325 days.

(21) Appl. No.: 10/054,280

(22) Filed: Jan. 22, 2002

(65) Prior Publication Data

US 2003/0136862 A1 Jul. 24, 2003

(51) Int. Cl.[7] ..... B05B 7/06

(52) U.S. Cl. ..... 239/424; 239/418; 239/556; 239/566

(58) Field of Search ..... 239/424, 423, 239/418, 101, 556, 566, DIG. 8

(56) References Cited

U.S. PATENT DOCUMENTS 3,613,999 A * 10/1971 Bentley et al. ..... 239/553.3
4,828,174 A * 5/1989 Love, III ..... 239/11
5,368,233 A * 11/1994 Brusko ..... 239/290
5,547,129 A * 8/1996 Fortunato et al. ..... 239/132.3

* cited by examiner

*Primary Examiner*—Dinh Q. Nguyen
(74) *Attorney, Agent, or Firm*—Leydig, Voit & Mayer, Ltd.

(57) ABSTRACT

A spray bar having a plurality of laterally spaced nozzles mounted in a row on a header block for discharging a row of liquid spray patterns, and a method of manufacture. The spray bar header includes a plurality of separate plates, each formed with a plurality of nozzle-receiving apertures and with one or more faces of adjacent interfacing plates being formed with grooves which define fluid passages for the supply liquid, atomizing and nozzle-actuating air, and heating fluid. The plates preferably are electroplated/electropolished for thorough and efficient cleaning upon disassembly.

38 Claims, 6 Drawing Sheets

MULTI-NOZZLE SPRAY BAR WITH SEGMENTED HEADER

FIELD OF THE INVENTION

This present invention relates generally to spraying devices, and more particularly, to spray bars that have a plurality of spray nozzles disposed in a row in lateral side by side relation for directing a curtain discharging liquid spray particles, such as spray bars that are mounted in transverse relation to a moving conveyor for spraying coatings or other substances on items being conveyed past the spray bar.

BACKGROUND OF THE INVENTION

Conventional spray bars commonly comprise an elongated block-like header that supports a plurality of spray nozzles in side-by-side relation, with the header block being formed with passageways that extend along the length of the header block for communicating liquid, air, or other fluids to the nozzles and to actuating mechanisms for the nozzles. Such conventional spray bars had been subject to various manufacturing and performance drawbacks.

At the outset, the elongated liquid and air passages in the header block typically are formed by gun drilling, a well-known machining procedure for forming relatively long bores such as gun barrel bores. Gun drilling is tedious and expensive. Moreover, as greater numbers of passages are required in the header block, such as when the header block must also supply air for both liquid atomization and nozzle actuation, the multiplicity of passages can become complex, limiting the number of spray nozzles or their mode of operation. This can limit the width of the liquid spray curtain, or the ability to selectively control the spray curtain width.

Conventional spray bars also are not susceptible to easy or thorough cleaning, such as required for sterile or uncontaminated spraying food substances and pharmaceuticals. Furthermore, by reason of inaccessibility into gun-drilled holes of the header block, the fluid passages are not susceptible to electropolishing as required for effective cleaning.

Performance problems also exist with existing spray bars, particularly when spraying highly viscous substances, such as liquid chocolate. Pressure losses occurring along the length of the passages within the header block result in the supply liquid being communicated to differently located nozzles at different inlet pressures. The resulting non-uniform spray discharge from the individual nozzles, in turn, results in non-uniform product application.

OBJECTS AND SUMMARY OF THE INVENTION

It is the object of the present invention to provide a multi-nozzle spray bar adapted for more economical manufacture and reliable operating performance.

Another object is to provide a spray bar as characterized above which has a header block with fluid supply passages that can be economically produced without tedious and expensive gun drilling. A related object is to provide such a spray bar header block that can be formed with more complex arrays of fluid passages for enhanced and more versatile spraying operations.

A further object is to provide a spray bar of the above kind which is adapted for selectively directing spray curtains of different widths.

Yet another object is to provide a spray bar of the foregoing type which has a plurality of zones of independently controllable spray nozzles.

Another object is to provide a spray bar of the above type which is effective for spraying sterile and contaminate-free liquids, such as food substances and pharmaceuticals.

A further object is to provide a spray bar having a header block adapted for easier and more effective cleaning. A related object is to provide a spray bar header block with electropolished fluid passages.

Still another object is to provide a spray bar of the foregoing type that is operable in directing substantially uniform spray patterns from each of the plurality of spray nozzles, even when spraying relatively viscous liquid products. A related object is to provide a spray bar having a header block with passages designed to communicate liquid to a multiplicity of differently located spray nozzles at substantially uniform pressures for substantially uniform liquid discharge.

Yet a further object is to provide a novel method of manufacturing a spray bar in accordance with the invention.

Other objects and advantages of the invention will become apparent upon reading the following detailed description and upon reference to the drawings, in which:

Figure 1:
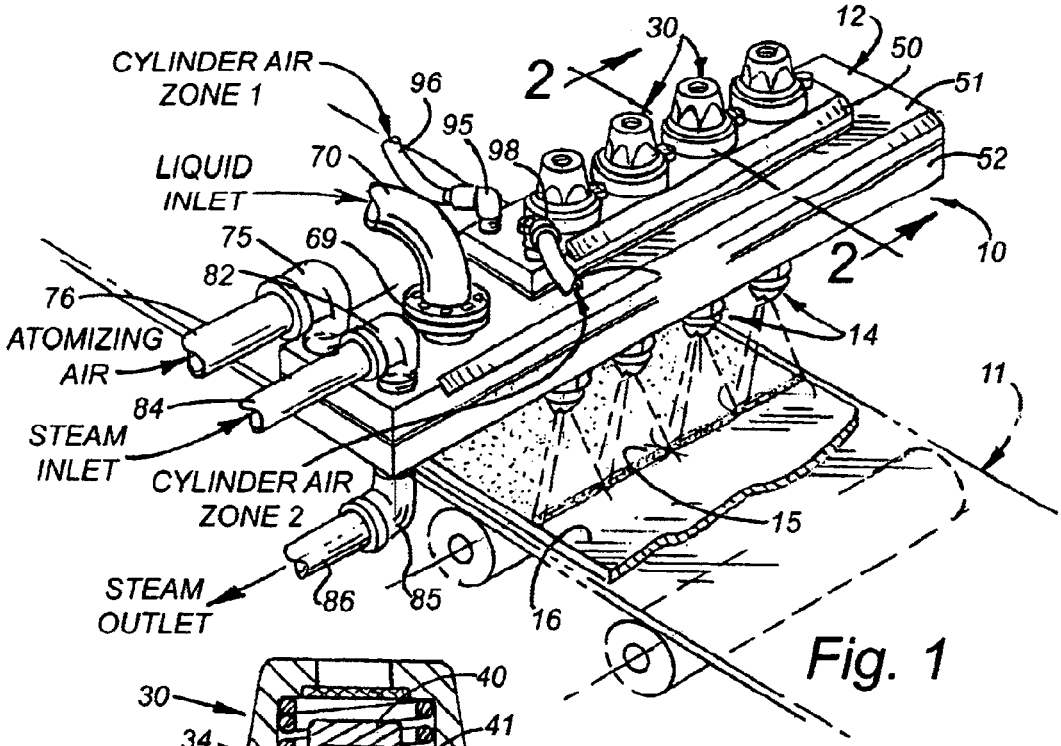
FIG. 1 is a perspective of an illustrative multi-nozzle spray bar in accordance with the invention shown spraying a liquid coating onto a product moving on a conveyor under the spray bar.

While the invention is susceptible of various modifications and alternative constructions, certain illustrative embodiments thereof has been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF PREFERRED EMBODIMENTS

Referring more particularly to FIG. 1 of the drawings, there is shown an illustrative spray bar 10 embodying the present invention supported in transverse elevated relation to a conveyor 11. The spray bar 10 includes a header block 12 which supports a plurality of laterally spaced spray nozzles 14 in a row for directing a transverse curtain of liquid spray 15 for coating a substrate 16 moving on the conveyor belt 11 under the spray bar 10. As will become apparent to one skilled in the art, the spray bar 10 may be used to spray various liquid substances, including foods, pharmaceuticals, chemicals, or like substances, in different processing environments.

The illustrative spray nozzles 14 are air atomizing nozzles of a type similar to that disclosed in U.S. Pat. No. 5,707,010, assigned to the same assignee as the present application, the disclosure of which is incorporated by reference. Each of the illustrated spray nozzles 14 comprises a nozzle body 18 having an upstream stem 19 threaded into an underside of the header block 12 and an air cap 20 secured on a discharge end of the nozzle body 18 by a retaining nut 21. The nozzle body 18 is formed with a central liquid passage 22 for directing a supply liquid through a tip insert 24 mounted in a downstream end of the liquid passage 22 in coaxial aligned relation to a spray discharge orifice 25 in the air cap 20. The nozzle body 18 further has one or more side passages 26 for communicating pressurized air to an annular air chamber 28 defined between the cap 20 and nozzle body 18 in surrounding relation to the tip insert 24 for intermixing pressurized air with liquid directed through the liquid passage 22 and tip insert 24 for intermixing, preatomization, and ultimate discharge of the liquid spray from the nozzle cap discharge orifice 25.

For controlling the discharge of liquid spray from the nozzles, each nozzle 14 has a respective actuator or air cylinder 30 mounted on an opposite upper side of the header block 12. Each actuator 30 includes an elongated valve needle 31 that extends through the header block 12 for reciprocating movement relative to the tip insert 24. The valve needle 31 is supported for movement by an annular sleeve 33, which in turn is supported at one end within the header block 12 and at another end by a packing nut 34 threaded into an upper side of the header block 12.

For operating the valve needle 31, the actuator 30 has a drive piston assembly 32 and a compression spring 34 which is confined between an upper end of the piston assembly 32 and an end cap 35, which also is supported in threaded engagement with an upper side of the header block 12. The piston assembly 32 includes a piston 36 and a resilient annular sealing ring 38 which has sliding sealing engagement with an inner surface of a cylindrical bore 39 formed co-axially in the end cap 35. The sealing ring 38 is held in position on the piston assembly by a retainer cap 40 threaded onto a upper stem portion 36*a* of the piston 36. An enlarged end portion 41 of the valve needle 31 is connected to the piston 36 by being captured between the outer end of the piston stem portion 36*a* and an end wall of the retainer cap 40. Accordingly, the valve needle 31 is movable axially in the nozzle body 18 in accordance with selective axial movement of the piston assembly 32.

The compression spring 34 biases the piston assembly 32, and hence the valve needle 31, toward a fully seated, i.e., valve "closed" position against the tip insert 24. The valve needle 31 is moved axially in the opposite direction (upwardly in FIG. 1) against the force of spring 34 by pressurized air or other fluid supplied to a cylinder chamber 44 adjacent the underside of the moveable piston assembly 32. It will be appreciated, therefore, that the valve needles 31 of each of the spray nozzles 14 supported by the header block 12 may be operated between on and off positions through selected supply of pressurized fluid to the respective actuator chamber 44.

In accordance with an important aspect of the invention, the header block has a multiple part construction, which can be economically produced with the necessary fluid supply passages for the multiplicity of spray nozzles without tedious and costly gun drilling and which also lends itself to easy and thorough cleaning. More particularly, the header block comprises a plurality of plates, which when assembled, have interfaces that define a network of fluid passages for the supply liquid, as well as fluids for atomizing the liquid during spraying, for controlling operation of the spray nozzles, and for heating the header block and supply liquid as it is directed to the nozzles. To this end, the illustrated header block 12 comprises three flat plates, namely, an upper plate 50, a center plate 51, and a lower plate 52. The upper plate 50 in this instance is secured to the center plate 51 by a row of screws 53 with a sealing gasket 54 therebetween, and the lower plate 52 is secured to the center plate 51 by parallel rows of screws 55 with a sealing gasket 56 interposed therebetween. Each of the plates 50, 51, 52 preferably has a relatively small thickness, such that the assembled header block 12 has an elongated narrow depth and width profile upon which the nozzles 14 are mounted in a row in close side-by-side relation. The upper plate 50 in this case has a shorter length than the center and lower plates 51, 52.

Figure 2:
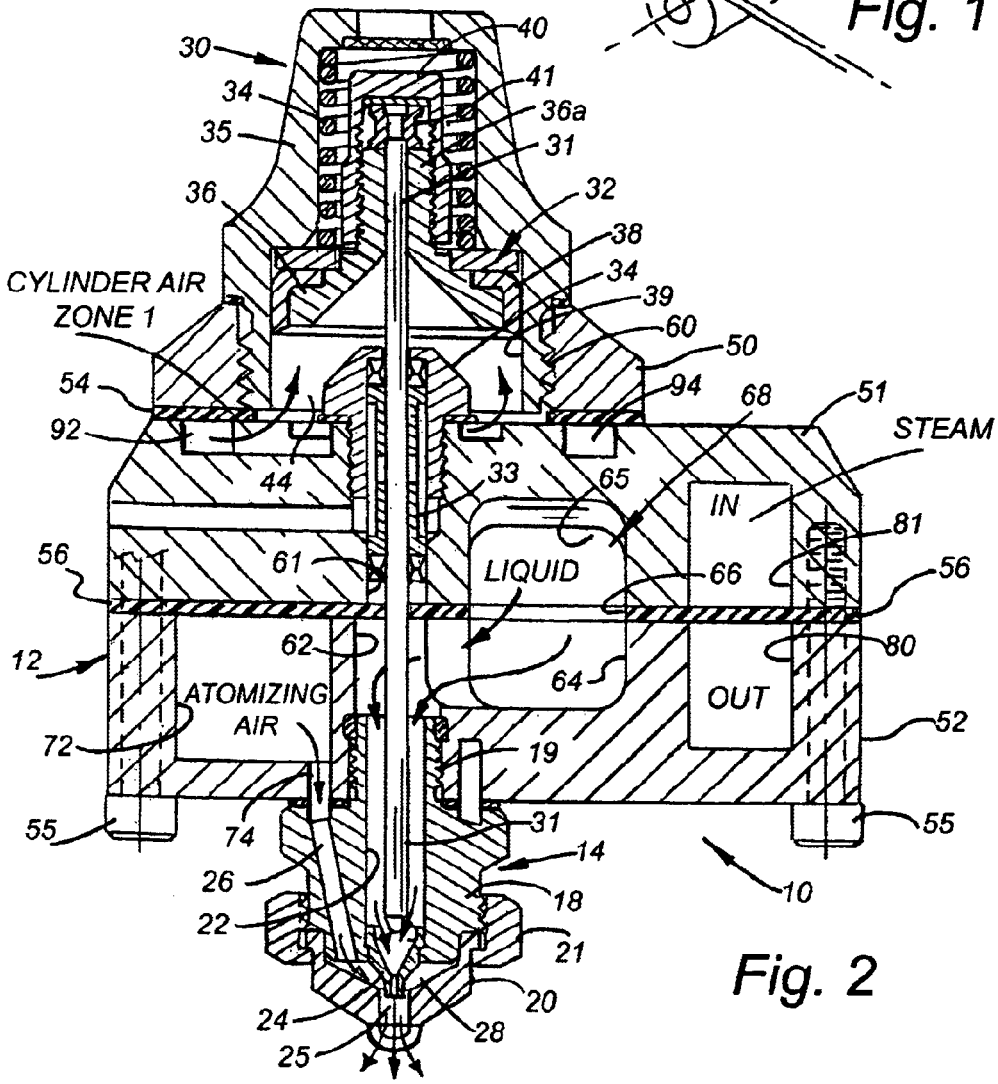
FIG. 2 is an enlarged vertical section of the illustrated spray bar taken in the plane of line 2—2 in FIG. 1, showing a spray nozzle in one of the spray zones and its actuating mechanism.
Figure 3:
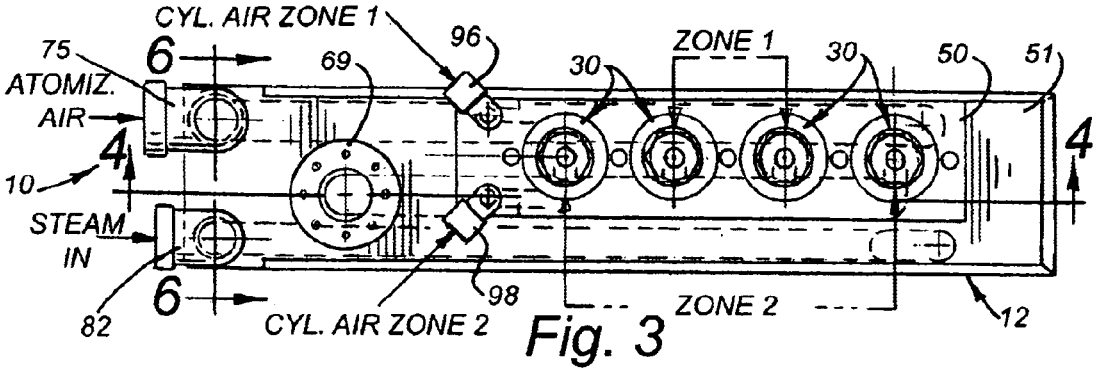
FIG. 3 is a top plan view of the illustrated spray bar.
Figure 4:
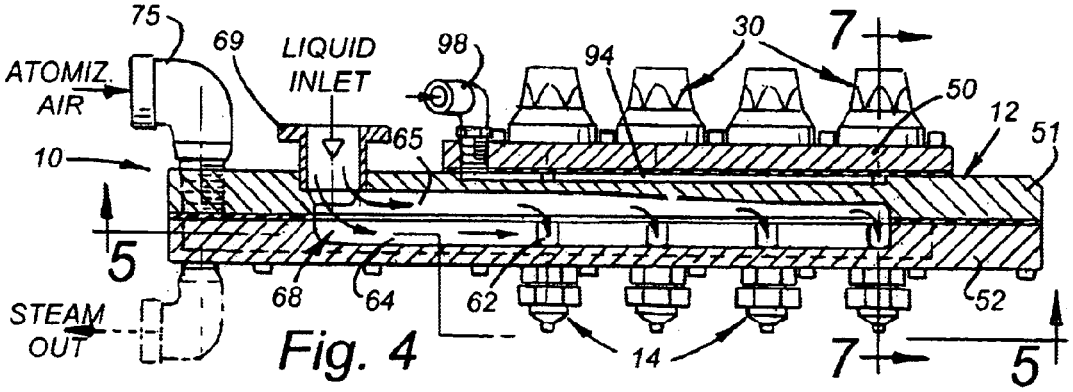
FIG. 4 is a longitudinal, vertical section of the spray bar, taken in the plane of line 4—4 in FIG. 3.
Figure 5:
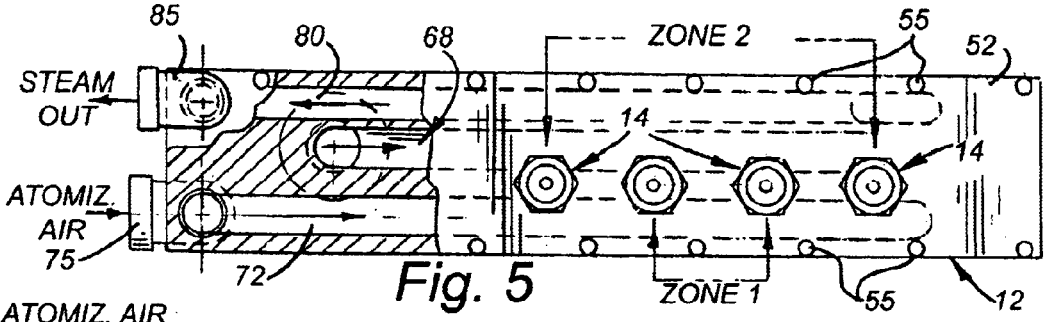
FIG. 5 is a bottom plan view, in partial section, of the spray bar, taken in the plane of line 5—5 in FIG. 4.
Figure 8:
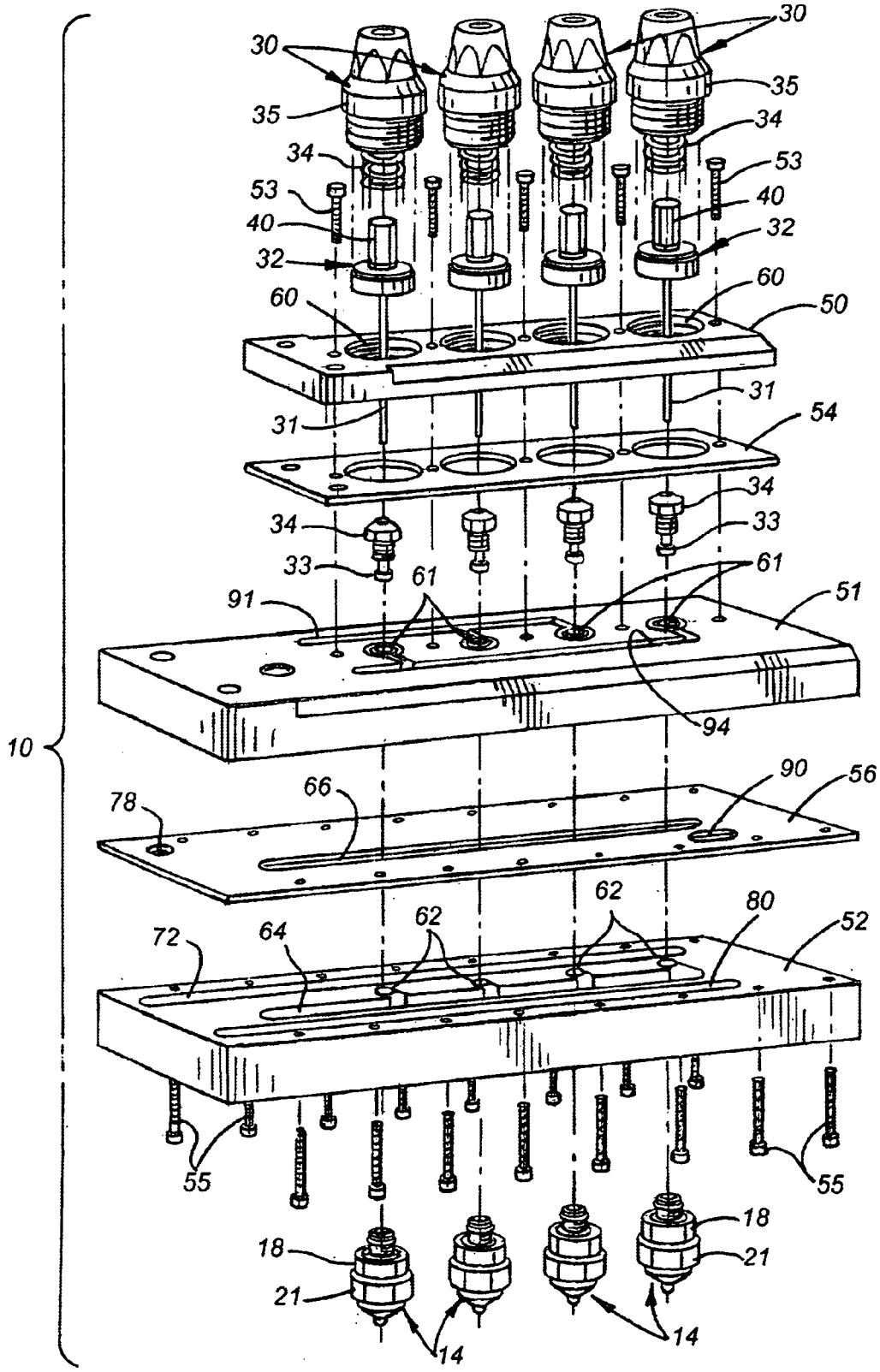
FIG. 8 is an exploded perspective of the illustrated spray bar.
Figure 9:
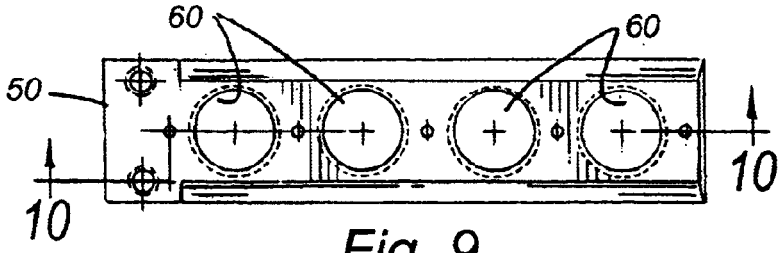
FIG. 9 is a top plan view of a top plate of the header block of the illustrated spray bar.
Figure 10:
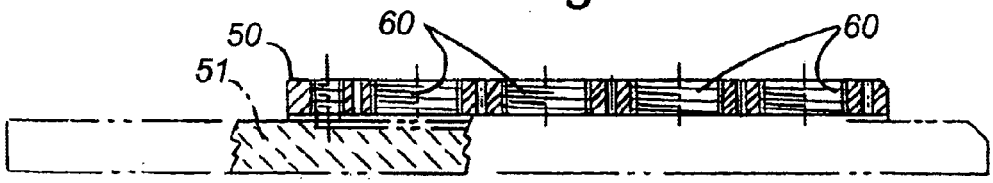
FIG. 10 is a longitudinal, vertical section of the header block top plate, taken in the plane of line 10—10 in FIG. 9.
Figure 11:
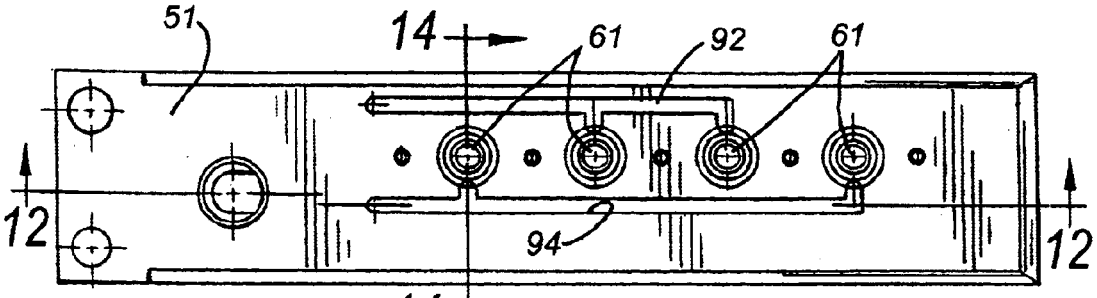
FIG. 11 is a top plan view of a center plate of the header block of the illustrated spray bar.
Figure 12:
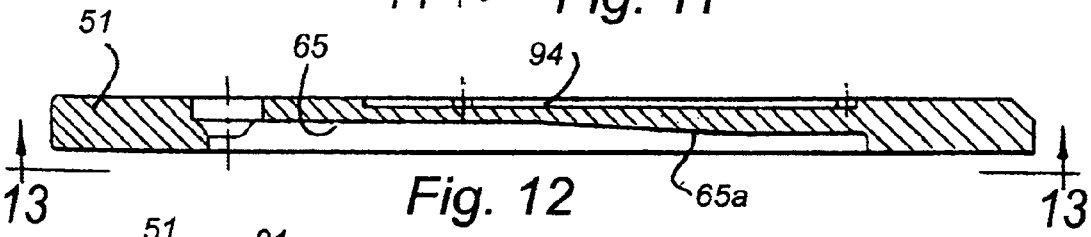
FIG. 12 is a longitudinal, vertical section of the header block center plate, taken in the plane of line 12—12 in FIG. 11.
Figure 13:
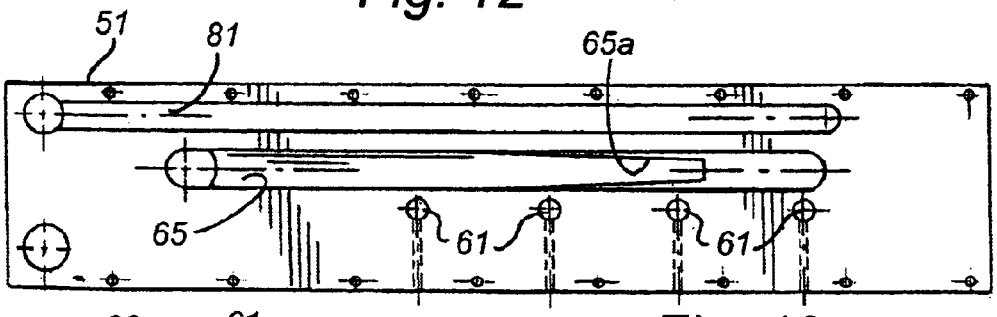
FIG. 13 is a bottom plan view of the header block center plate, taken in the plane of line 13—13 in FIG. 12.
Figure 14:
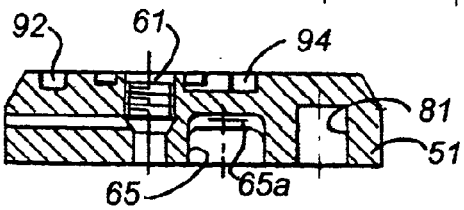
FIG. 14 is an enlarged transverse, vertical section of the header block center plate, taken in the plane of line 14—14 in FIG. 11.
Figure 15:
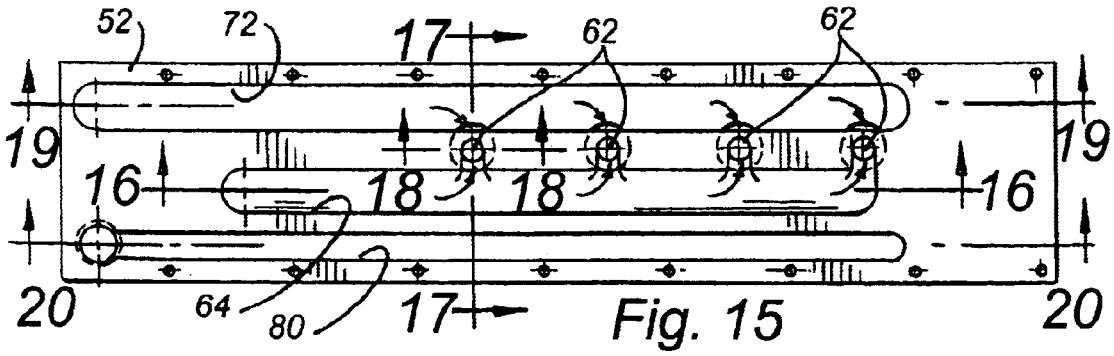
FIG. 15 is a top plan view of a bottom plate of the header block of the illustrated spray bar.
Figure 16:
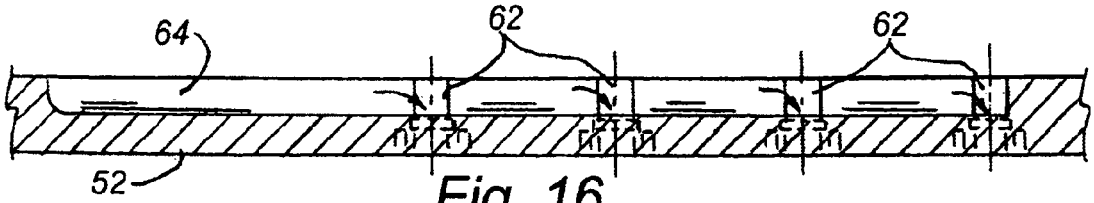
FIG. 16 is an enlarged fragmentary section of the header block bottom plate, taken in the plane of line 16—16 in FIG. 15.
Figure 17:
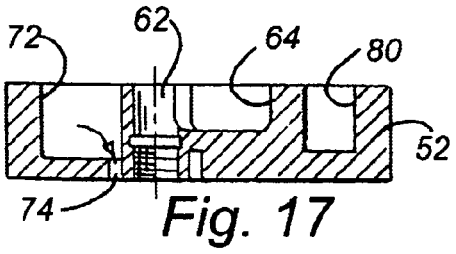
FIG. 17 is an enlarged transverse, vertical section of the header block bottom plate, taken in the plane of line 17—17 in FIG. 15.
Figure 18:
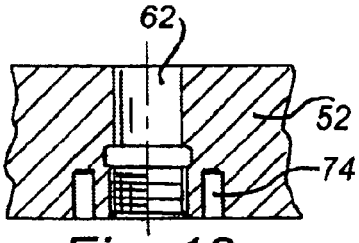
FIG. 18 is an enlarged fragmentary section of the header block bottom plate, taken in the plane of line 18—18 in FIG. 15.
Figure 19:
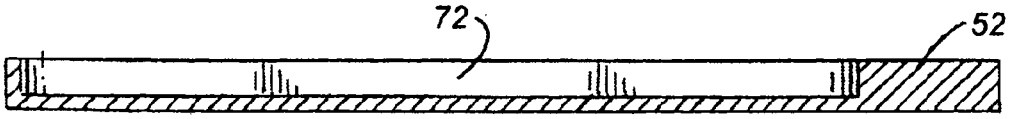
FIGS. 19 and 20 are longitudinal vertical sections of the header block bottom plate, taken in the planes of 19—19 and 20—20, respectively, in FIG. 15.
Figure 20:
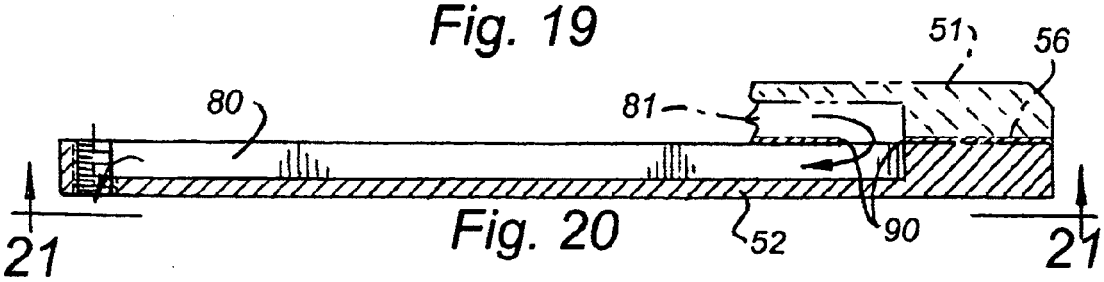
Figure 21:
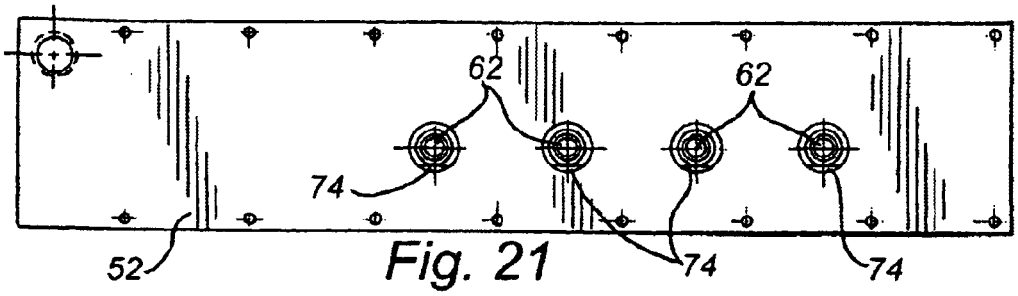
FIG. 21 is a bottom plan view of the header block bottom plate, taken in the plane of line 21—21 in FIG. 20.

For supporting the nozzles 14 and their actuators 30 in the header block 12, the top, center and lower plates 50, 51 and 52 are formed with respective coaxial bores 60, 61 and 62 for receiving the actuator end cap 35, packing nut 34 and nozzle body 18, respectively (FIGS. 2 and 8). It will be understood by one skilled in the art that such bores may be economically formed in the respective plates by conventional boring, drilling, and tapping machines. As will become apparent, appropriate openings also are formed in the interposed gaskets 54, 56.

In carrying out the invention, at least some of the plates are formed with longitudinally extending grooves or other suitable recesses on horizontal faces thereof, which upon assembly of the plates in stacked interfaced relation to each other, define a network of fluid directing passages. As will become apparent, the fluid passages may be defined by grooves in the face of one plate that is covered by the flat face of an adjacent plate, or alternatively, the fluid passages may be defined by grooves in the face of one plate and corresponding grooves formed in the adjacent facing plate, which together define the flow passages. For purposes herein, the interposed gasket may be deemed a face of an adjacent plate. In the illustrated embodiment, the upper horizontal surface of the bottom plate 52 and the underside surface of the center plate 51 are formed with respective elongated grooves 64, 65, which together with a corresponding slot 66 in a gasket 56, define a supply liquid passage 68 communicating with each of the nozzle receiving bores 62, as depicted in FIG. 2. For directing supply liquid to the supply passage 68, an inlet ferrule 69 connected to a supply liquid feed line 70 is mounted in a drilled hole in the center plate 51 in communication with the juxtaposed grooves 64, 65. It will be understood that while the illustrated grooves 64, 65 have a U-channel shape, the fluid passage may be defined by other shaped recesses at the interface between the mating plates.

Figure 6:
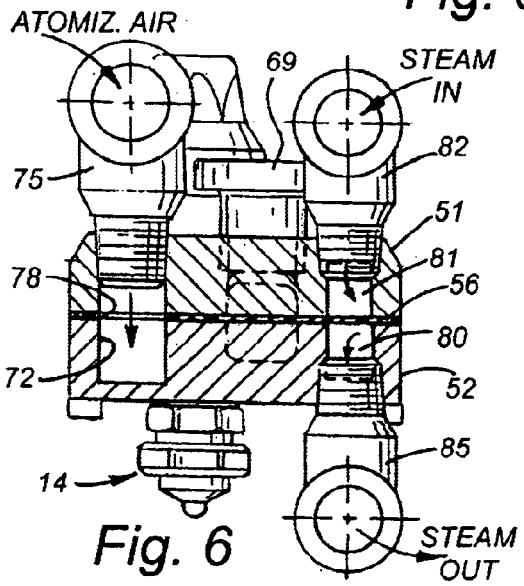
FIG. 6 is an enlarged transverse, vertical section through an inlet end of the spray bar, taken in the plane of line 6—6 in FIG. 3.
Figure 7:
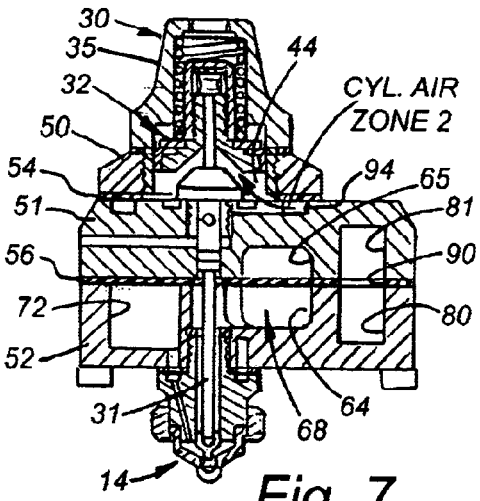
FIG. 7 is an enlarged transverse, vertical section of the spray bar taken in the plane of line 7—7 in FIG. 4, showing a nozzle in another spray zone of the illustrated spray bar.

In further carrying out the invention, for directing atomizing air to the nozzles 14 to atomize the supply liquid prior to discharge from the nozzles 14, the upper face of the bottom plate 52 is formed with an elongated groove 72 which extends along the length of the bottom plate in parallel relation to the liquid supply groove 64 on an opposite side of the nozzle-receiving bores 62. Upon assembly of the center and bottom plates 51, 52, the groove 72 defines an atomizing air flow passage which communicates with an annular passage 74 in the underside of the bottom plate 52, which in turn communicates with the side bores 26 of the nozzle body 18. For directing atomizing air to the atomizing air passage groove 72, an elbow 75 connected to a pressurized air supply line 76 is mounted in the center plate 51 in fluid communication with the groove 72 through an aperture 78 in the interposed gasket 56 (FIGS. 6 and 8).

For supplying a heating fluid through the header block 12 to maintain the supply liquid at a predetermined temperature for efficient spraying, such as necessary when spraying viscous food substances, the upper surface of the bottom plate 52 and bottom surface of the center plate 51 are formed with juxtaposed grooves 80, 81 which are separated along their length by the interposed gasket 56 An inlet elbow 82 connected to a heating fluid (such as steam) supply line 84 is mounted in an upstream end of the center header plate 51 in fluid communication with the groove 81. An outlet elbow 85 connected to a steam outlet and recirculating line 86 is connected to the underside of the bottom plate 52 in communication with the groove 80. Steam directed into the inlet elbow 82 proceeds along a first passage defined by the groove 81 and gasket 56 substantially the length of the header plate 52 then communicates through an aperture 90 in the gasket 56 with the groove 80 for return flow in a return or second passage defined by the groove 80 and gasket 56 to the outlet elbow 85 and steam outlet line 86. As will be understood by one skilled in the art, by heating the header block through appropriate control of the inlet steam, the liquid directed through the supply passage 68 may be maintained at the proper temperature for optimum spraying.

In accordance with a further aspect of the invention, operation of the spray nozzles is controllable for selectively establishing a desired width of the discharging spray curtain. To that end, in the illustrated embodiment, the nozzles are arranged in zones which can be individually controlled for the required spray operation. In the illustrated embodiment, the nozzles 14 are arranged for operation in two zones, zone 1 being the two middle nozzles 14 in the row and zone 2 being the two nozzles 14 at opposite ends of the row. For directing pressurized air (i.e., cylinder air) to the actuators 30 of the nozzles 14 in zone 1, the upper face of the center header plate 51 is formed with a longitudinal extending groove 92 on one side of the actuators 30 that communicates with the air chambers 44 of the actuators 30 of the nozzles 14 of that zone. For supplying pressurized air to the actuator nozzle of zone 2, the upper face of the center plate 51 is formed with a second longitudinally extending groove 94, parallel to the first groove 92 on an opposite side of the actuators 30, for communicating pressurized air to the air chambers 44 of the nozzle actuators 30 of that zone, namely the nozzles 14 at opposite ends of the row.

For supplying pressurized air to the groove 92 and the actuators 30 for the nozzles 14 of zone 1, an inlet elbow 95 connected to a pressurized air supply line 96 is mounted in the top plate 50 in communication with an upstream end of the groove 92. For supplying pressurized air to the actuators 30 for the nozzles 14 of zone 2, a similar inlet elbow 98 connected to a pressurized supply line 99 is mounted in the top plate 50 in communication with the groove 94. It will be understood that pressurized air to the supply lines 96 and 99 may be individually controlled, such as through respective solenoid control valves, to selectively actuate spraying from the nozzles of zone 1, or the nozzles of zone 2, or the nozzles of both zones 1 and 2. It can be seen that actuating only nozzles of zone 1 results in a relatively short width spray curtain, while the actuation of the nozzles of both zone 1 and zone 2 effects a substantially greater width spray curtain. While the illustrated spray bar has two zones of selectively operable spray nozzles, it will be understood that the spray bar similarly may be provided with greater numbers of individually controlled zones of spray nozzles.

In further carrying out the invention, the spray bar 12 is adapted for improved operating performance, particularly when spraying highly viscous materials, such as liquid chocolate which incurs significant pressure drops along the length of travel through the supply passage to the respective nozzles. In the illustrated embodiment, the liquid supply passage 68 defined by the juxtaposed grooves 64, 65 has a narrowing cross-sectional area in a downstream direction, such that liquid is supplied to each nozzle at substantially uniform pressure for substantial uniform discharge. In the illustrated embodiment, the U-shaped groove 65 has a bottom surface 65*a*, that tapers toward the plate interface in a downstream direction to gradually constrict the flow passage area to compensate for pressure losses. As will be understood by one skilled in the art, the inwardly tapered groove 65 may be formed by conventional milling. Hence, each of the plurality of nozzles 14 of the spray bar 12 is operable for directing a substantially uniform spray distribution, which in turn results in a uniform coating on the substrate 16.

Figure 22:
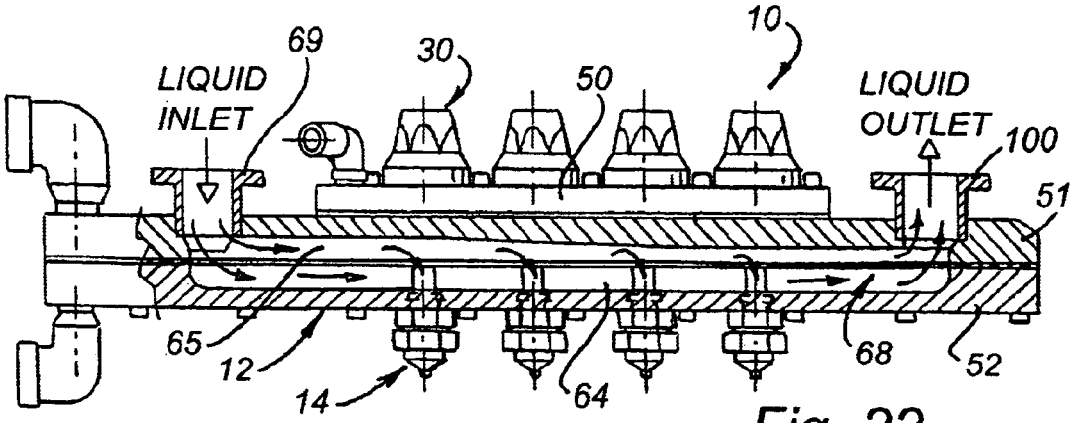
FIG. 22 is an alternative embodiment of spray bar in accordance with the invention.
Figure 23:
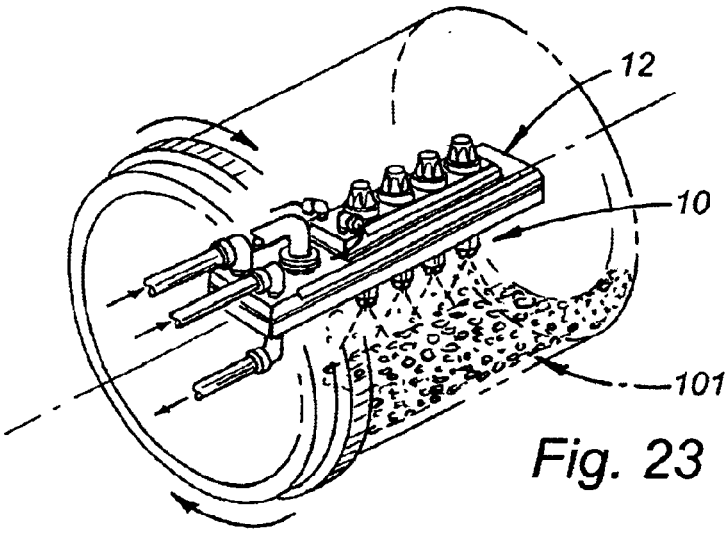
FIG. 23 is a perspective of a spray bar, similar to that depicted in FIG. 1, but mounted within a rotatable processing tumbler.

It will be understood that the multiple plate construction of the header 12 enables easy reconfiguration of the flow passages for particular applications or needs. FIG. 22, for example, shows a spray bar similar to that described above, but with the supply liquid passage 68 communicating with an outlet ferrule 100 at a downstream end of the header to permit recirculation of the supply liquid, such as when the nozzles are in their shut-off condition. Moreover, while the spray bar 10 has been illustrated for use in spraying a coating onto substrates or other products being conveyed past the spray bar, the spray bar may be used in various other processing environments. FIG. 23, for example, shows a spray bar, similar to that shown in FIG. 1, mounted for directing spray in a rotatable processing tumbler 101.

In further keeping with the invention, the header block 12 is adapted for easy and thorough cleaning. By removing the fastening screws 53, 55, the plates 50, 51, 52 can be readily disassembled to permit thorough cleaning. For that purpose, the header plates 50, 51, 52, preferably are electroplated/electropolished to provide a surface finish for enhanced cleaning. It will be understood that since the plates 50, 51, 52 each have a relatively narrow thickness, the plates lend themselves to electroplating by conventional processing, with the narrow depth grooves and bores being fully accessible to the processing solution. Preferably, brass plates would be provided with a brass nickel plating, stainless steel plates would be electropolished, and aluminum plates would be anodized. For purposes herein, electroplating is intended to encompass each of said surface finishing techniques.

Figure 24:
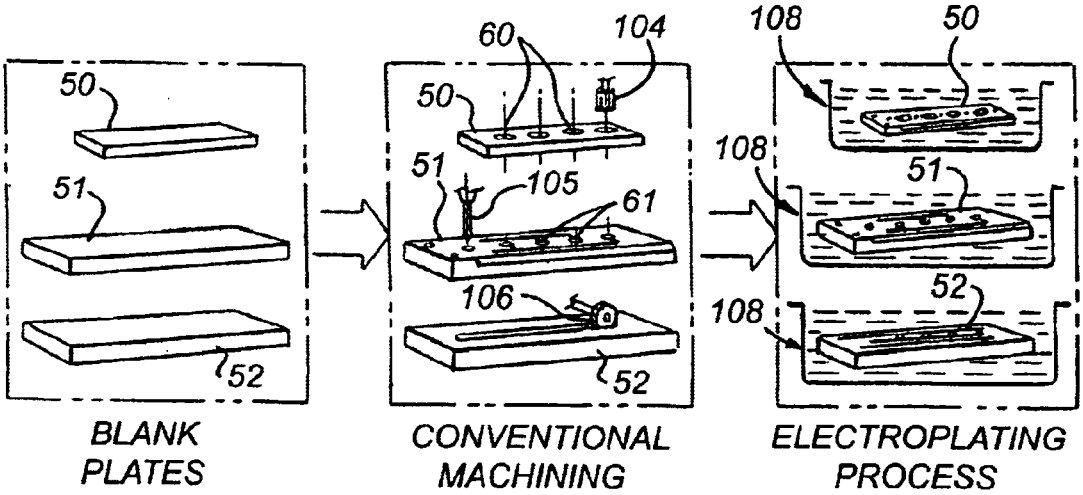
FIG. 24 is a schematic illustration of a method of making the header blocks of the illustrated spray bars.

By reason of the foregoing, in further carrying out the invention, the header block 12 is susceptible to economical manufacture without costly gun drilling as heretofore required in the art. As depicted in FIG. 24, a method of manufacture of the header block 12 may include providing three blank plates corresponding to the top, center and bottom header plates 50, 51, 52, boring and drilling the transverse actuator and nozzle receiving apertures 60, 61, 62 in the plates by conventional machinery 104, 105, respectively, and forming the passage-defining grooves by a conventional milling cutter 106. With the bores and milled grooves being of relatively shallow depth, the plates 50, 51 and 52 can then be electroplated in a conventional process tank 108. Thereafter, the plates 50, 51, 52 can be assembled with the nozzles 14 and actuators 30.

From the foregoing, it can be seen that the multi-nozzle spray bar of the present invention is adapted for both economical manufacture and reliable operating performance. The segmented, multi-plate header block enables the fluid supply passageways to be economically formed in the header without tedious and expensive gun drilling. The passageways, furthermore, may be complexly designed for enhanced and more versatile spraying operations. The spray bar, which comprises a plurality of completely electropolished plates, also can be easily disassembled for thorough cleaning.

What is claimed is:

1. A spray bar for spraying liquids comprising:

a header block, a plurality of liquid spray nozzles mounted on said header block, said header block including a plurality of separate plates, said plates being secured together with faces of adjacent plates in interfacing relation to each other;

at least one of said faces being formed with a groove which together with an adjacent plate defines a supply liquid passage for communicating liquid from a supply liquid inlet to at least one of said nozzles for discharge from said at least one nozzle as a liquid spray, said nozzles each having a respective fluid operated actuator for controlling the discharge of liquid from the nozzle, and at least one of said faces is formed with a groove which together with an adjacent plate defines an actuating fluid passage for communicating pressurized fluid from a pressurized fluid inlet to the actuator for said at least one nozzle for operating the actuator and controlling the liquid discharge from said at least one nozzle.

2. The spray bar of claim 1 in which said adjacent faces are flat.

3. The spray bar of claim 1 in which said grooves have a U-shape.

4. The spray bar of claim 1 in which said nozzles are air atomizing nozzles, at least one of said faces being formed with a groove which together with an adjacent plate defines an atomizing air passage for directing pressurized air from a pressurized air inlet to said at least one nozzle for atomizing liquid directed to said at least one nozzle from said liquid supply passage.

5. The spray bar of claim 1 in which at least one of said faces being formed with a groove which with an adjacent plate defines a heating fluid passage for communicating a heating fluid from a heating fluid supply through the header to heat the header and liquid communicating through said supply liquid passage.

6. The spray bar of claim 1 in which said supply liquid passage communicates with a plurality of said nozzles, and said actuation fluid passage communicates with a plurality of said nozzle actuators.

7. The spray bar of claim 6 in which said nozzles are mounted in a row in side-by-side relation to each other.

8. The spray bar of claim 6 in which at least one of said faces is formed with a second groove which together with an adjacent plate defines a first actuating air passage for directing pressurized air from a pressurized air source to a first plurality of actuators for simultaneously controlling operation of a first plurality of nozzles, and at least one of said faces being formed with a third groove which together with an adjacent plate defines a second actuating air passage for communicating pressurized air from a pressurized air source to a second plurality of actuators different from said first plurality of actuators for simultaneously controlling operation of a second plurality of nozzles different from said first plurality of nozzles.

9. The spray bar of claim 8 in which said second and third grooves are formed on a common face on opposite sides of said actuator.

10. The spray bar of claim 1 in which said header includes three plates, at one of the adjacent faces of first and second of said plate defining said supply liquid passage, and at least one of the adjacent faces of said second and third plates defining said actuating fluid passage.

11. The spray bar of claim 1 in which one of said plates is defined with a plurality of apertures which each receive a respective one of said nozzles, and another of said plates is formed with a plurality of said apertures in coaxial alignment with the apertures of said first plate for receiving respective nozzle actuators.

12. A spray bar for spraying liquids comprising:

a header block, a plurality of liquid spray nozzles mounted in side-by-side relation on said header block, said header block including a plurality of separate plates, said plates being secured together with faces of adjacent plates in interfacing relation to each other;

at least one interface between adjacent plates defining a supply liquid passage for communicating liquid from a supply liquid inlet to a plurality of said nozzles for discharge from said plurality of nozzles as liquid sprays, said nozzles each having a respective fluid operated actuator for controlling the discharge of liquid from the nozzle, and at least one of said faces is formed with a groove which together with an adjacent plate defines an actuating fluid passage for communicating pressurized fluid from a pressurized fluid inlet to the actuators for said at least one nozzle of said plurality of nozzles for operating the actuator and controlling the liquid discharge from said at least one nozzle.

13. The spray bar of claim 12 in which said nozzles are air atomizing nozzles, at least one of said faces being formed with a groove which together with an adjacent plate defines an atomizing air passage for directing pressurized air from a pressurized air inlet to said plurality of nozzles for atomizing liquid directed to said plurality of nozzles from said liquid supply passage.

14. The spray bar of claim 13 in which at least one of said faces being formed with a groove which with an adjacent plate defines a heating fluid passage for communicating a heating fluid from a heating fluid supply through the header to heat the header and liquid communicating through said supply liquid passage.

15. The spray bar of claim 12 in which at least one of said faces is formed with a groove which together with an adjacent plate defines a first actuating air passage for directing pressurized air from a pressurized air source to a first plurality of actuators for simultaneously controlling operation of a first plurality of said nozzles, and at least one of said faces being formed with a groove which together with an adjacent plate defines a second actuating air passage for communicating pressurized air from a pressurized air source to a second plurality of actuators different from said first plurality of actuators for simultaneously controlling operation of a second plurality of nozzles different from said first plurality of nozzles.

16. The spray bar of claim 12 in which said header includes three plates, at one of the adjacent faces of first and second of said plate defining said supply liquid passage, and at least one of the adjacent faces between said second and third plates defining said actuating air passage.

17. The spray bar of claim 12 in which said supply liquid passage has a narrowing cross-sectional area in a downstream direction such that liquid is supplied to each nozzle at a substantially uniform pressure.

18. A method of making a spray bar for spraying a liquid comprising the steps of:

providing a plurality of plates, forming nozzle-receiving apertures in at least one of said plates, forming a first groove in a face of at least one of said plates, forming a plurality of nozzle actuator receiving apertures in another of said plates corresponding in number to said nozzle-receiving apertures, assembling said plates with respective nozzle-receiving apertures and actuator-receiving apertures in coaxial relation to each other, assembling a spray nozzle in each of said nozzle-receiving apertures, assembling said plates in adjacent interfacing relation to each other such that the groove in said face of at least one plate and an interfacing adjacent plate define a supply liquid passage for communicating liquid from a liquid supply inlet to said nozzles, assembling nozzle actuators in each of said actuator-receiving apertures, and forming a second groove in a face of one of said plates which upon assembly of said plates defines with an adjacent interfacing plate an actuating fluid passage for communicating pressurized fluid from a pressurized fluid inlet to at least some of said actuators.

19. The method of claim 18 including forming said groove and nozzle-receiving apertures in a common plate with said groove communicating with each of said nozzle-receiving apertures.

20. The method of claims 19 including forming said groove in a straight line along a length of the face of said at least one plate.

21. The method of claim 18 including electroplating said plates including the groove and nozzle-receiving apertures formed therein.

22. The method of claim 18 including assembling air assisted spray nozzles in said plates, and forming a second groove in a face of at least one of said plates which together with an adjacent interfacing plate defines an atomizing air passage for communication between a pressurized air inlet and said nozzles.

23. The method of claim 22 including forming said first groove in a face of one of said plates and forming said second groove in a face of another of said plates.

24. The method of claim 22 including forming a third groove in a face of one of said plates which upon assembly of said plates defines with an adjacent interfacing plate a heating fluid passage for communicating a heating fluid from a heating fluid supply through said plates.

25. The method of claim 18 including forming a third groove in a face of at least one of said plates which upon assembly of said plates defines within an adjacent interfacing plate a second actuating fluid passage for communicating pressurized fluid from a pressurized fluid inlet to a second plurality of said actuators different from said at least some of actuators.

26. The method of claim 25 including forming said first and second grooves on a common face of one of said plates on opposite sides of said actuator-receiving apertures.

27. The method of claim 25 including providing three plates, and forming said nozzle-receiving and actuator-receiving apertures in respective coaxial relation through each of said three plates.

28. The method of claim 18 including forming said nozzle-receiving openings in a straight line, and forming said first groove in a straight line along a side of said nozzle-receiving apertures.

29. A spray bar for spraying liquids comprising:

a header block, a plurality of liquid spray nozzles mounted on said header block, said header block including a plurality of separate plates, said plates being secured together with faces of adjacent plates in interfacing relation to each other; and at least one of said faces being formed with a groove which together within adjacent plate defines a supply liquid passage for communicating liquid from a supply liquid inlet to at least one of said nozzles for discharge from said at least one nozzle as a liquid spray, said interfacing faces of two of said plates being formed with juxtaposed grooves which are separated by a gasket interposed therebetween, said gasket having an aperture adjacent an end and communicating between said juxtaposed grooves, one of said juxtaposed grooves and said gasket defining a heating fluid passage communicating between a heating fluid inlet and said gasket aperture, and another of said juxtaposed grooves and said gasket defining a return heating fluid passage communicating between said gasket aperture and a heating fluid outlet.

30. The spray bar of claim 29 in which said first plurality of nozzles define a first selectively controllable spray zone, and said second plurality of spray nozzles defines a second selectively controlled spray zone.

31. The spray bar of claim 30 in which said nozzles are mounted in a straight line, and said first spray zone includes at least one nozzle at each end of said line of nozzles, and said second spray zone includes nozzles between the nozzles of said first zone.

32. A spray bar for spraying liquids comprising:

a header block, a plurality of liquid spray nozzles mounted on said header block, said header block including a plurality of separate plates, said plates being secured together with faces of adjacent plates in interfacing relation to each other;

at least one of said faces being formed with a groove which together with an adjacent plate defines a supply liquid passage for communicating liquid from a supply liquid inlet to at least two of said nozzles for discharge from said at least two nozzles as a liquid spray, and said supply liquid passage having a narrowing cross-sectional area in a downstream direction such that liquid is supplied to each of said at least two nozzles at a substantially uniform pressure.

33. The spray bar of claim 32 in which said nozzles each have a respective fluid operated actuator for controlling the discharge of liquid from the nozzle, and at least one of said faces is formed with a groove which together with an adjacent plate defines an actuating fluid passage for communicating pressurized fluid from a pressurized fluid inlet to the actuator for said at least one nozzle for operating the actuator and controlling the liquid discharge from said at least one nozzle.

34. The spray bar of claim 33 in which said supply liquid and atomizing air passages are formed by grooves between interfacing first and second of said plates, and said actuating air passages are formed by a groove interfaced between second and third of said plates.

35. The spray bar of claim 32 in which said supply liquid passage defining groove is U-shaped, and a bottom surface of said U-shaped groove being tapered to constrict the area of said groove in a downstream direction.

36. A spray bar for spraying liquids comprising:

a header block, a plurality of liquid spray nozzles mounted on said header block, said header block including a plurality of separate plates, said plates being secured together with faces of adjacent plates in interfacing relation to each other;

one of said plates being formed with a plurality of apertures which each receive and support a respective one of said spray nozzles on one side of said header, another of said plates being formed with a plurality of apertures in coaxial alignment with the apertures of said one plate for receiving and supporting an actuator on an opposite side of said header for controlling the discharge of liquid spray from a respective spray nozzle in a coaxial aligned aperture, and at least one of said faces of said adjacent plates being formed with a groove which together with an adjacent plate defines a supply liquid passage for communicating liquid from a supply liquid inlet to at least one of said nozzles for discharge from said at least one nozzle as a liquid spray.

37. The spray bar of claim 36 in which at least one of said faces is formed with a groove which together with an adjacent plate defines an actuating fluid passage communicating pressurized fluid from a pressurized fluid inlet for said actuators for operating the actuator and controlling liquid discharge from at least one of said spray nozzles.

38. A spray bar for spraying, liquids comprising:

a header block, a plurality of liquid spray nozzles mounted on said header block, said header block including three separate plates, said plates being secured together with faces of adjacent plates in interfacing relation to each other;

at least one of the adjacent faces of first and second of said plates defining a supply liquid passage for communicating liquid from a supply liquid inlet to at least one of said nozzles for discharge from said at least one nozzle as a liquid spray; and at least one of the adjacent faces of second and third of said plates defining a control fluid passage for controlling the spray discharge.

* * * * *